US012643584B2

(12) United States Patent
Tomida et al.

(10) Patent No.: US 12,643,584 B2
(45) Date of Patent: Jun. 2, 2026

(54) FORWARD MONITORING DEVICE AND FORWARD MONITORING METHOD

(71) Applicant: Mitsubishi Electric Corporation, Tokyo (JP)

(72) Inventors: Masashi Tomida, Tokyo (JP); Yukitoshi Inaba, Tokyo (JP); Katsuyuki Kamei, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 683 days.

(21) Appl. No.: 18/003,573

(22) PCT Filed: Jul. 3, 2020

(86) PCT No.: PCT/JP2020/026225
§ 371 (c)(1),
(2) Date: Dec. 28, 2022

(87) PCT Pub. No.: WO2022/003958
PCT Pub. Date: Jan. 6, 2022

(65) Prior Publication Data
US 2023/0257008 A1 Aug. 17, 2023

(51) Int. Cl.
*B61L 23/34* (2006.01)
*B61L 15/00* (2006.01)
*B61L 25/02* (2006.01)

(52) U.S. Cl.
CPC ..... *B61L 23/34* (2013.01); *B61L 15/0072* (2013.01); *B61L 25/025* (2013.01)

(58) Field of Classification Search
CPC .... B61L 23/34; B61L 15/0072; B61L 25/025; B61L 25/021; B61L 25/026; B61L 23/041
See application file for complete search history.

(56) References Cited

U.S. PATENT DOCUMENTS

2016/0178755 A1* 6/2016 Kim ..... G01S 19/51 342/357.31
2018/0222505 A1* 8/2018 Chung ..... B61L 15/0027

FOREIGN PATENT DOCUMENTS

JP 2001116840 A 4/2001
JP 2019004587 A 1/2019
(Continued)

OTHER PUBLICATIONS

Machine Translation of JP 2019221115 A PDF File Name: "JP2019221115A_Machine_Translation.pdf" (Year: 2019).*
(Continued)

*Primary Examiner* — Grant Moubry
*Assistant Examiner* — Ruben Picon-Feliciano
(74) *Attorney, Agent, or Firm* — BUCHANAN, INGERSOLL & ROONEY PC

(57) ABSTRACT

A forward monitoring device includes a map information storage unit that stores track information representing a location and a track geometry of a track, a train information acquisition unit that obtains train location information on a train, and an interceptor presence-absence determination unit that determines, based on the track information, the train location information, and interceptor candidate information, whether there is an interceptor between the train and a first monitoring scope, when the forward monitoring device monitors an obstacle on the track in the first monitoring scope, the interceptor being not the obstacle, the interceptor blocking a view of the first monitoring scope from the train, the interceptor candidate information indicating candidates for the interceptor that blocks a view from the train, the first monitoring scope including a spot on the track at a first distance from the train along the track in the travelling direction of the train.

14 Claims, 10 Drawing Sheets

(56) References Cited

FOREIGN PATENT DOCUMENTS

| | | | | |
|---|---|---|---|---|
| JP | 2019221115 | A | * | 12/2019 |
| WO | 2019194017 | A1 | | 10/2019 |

OTHER PUBLICATIONS

Hearing Notice dated Jun. 14, 2024, issued in the corresponding Indian Patent Application No. 202227075922, 2 pages.
International Search Report (PCT/ISA/210) with translation and Written Opinion (PCT/ISA/237) mailed on Sep. 1, 2020, by the Japan Patent Office as the International Searching Authority for International Application No. PCT/JP2020/026225. (8 pages).
Office Action issued in corresponding Indian Patent Application No. 202227075922, mailed on Mar. 9, 2023, 6 pages.

* cited by examiner

FORWARD MONITORING DEVICE AND FORWARD MONITORING METHOD

FIELD

The present disclosure relates to a forward monitoring device and a forward monitoring method each for monitoring an area in the travelling direction of a train.

BACKGROUND

Trains conventionally monitor an area on the track in the travelling direction to detect an obstacle. Patent Literature 1 discloses technology for allowing a vehicle radar system to emit a radio wave from the train, and measure a reflected wave, thereby detecting an obstacle present on and by the track.

CITATION LIST

Patent Literature

Patent Literature 1: Japanese Patent Application Laid-open No. 2001-116840

SUMMARY

Technical Problems

For the foregoing conventional technology, unfortunately, the reflected wave may undergo a change under the influence of a structure etc. alongside the track even when the condition on the track in the travelling direction does not change. When a change occurs in the reflected wave, it is impossible to determine whether a cause of that change is an obstacle on the track or a structure located alongside the track. This presents a problem of obstacle recognition rate being not high, that is, a problem of possibility of misidentification of an obstacle.

The present disclosure has been made in view of the foregoing, and it is an object of the present disclosure to provide a forward monitoring device capable of reducing or preventing misidentification of an obstacle in monitoring an area in the travelling direction of a train.

Solution to Problem

To solve the above problem and achieve the object, the present disclosure provides a forward monitoring device to be installed on a train, the forward monitoring device comprising: a map information storage unit to store track information representing a location and a track geometry of a track on which the train is to run; a train information acquisition unit to obtain train location information on the train; and an interceptor presence-absence determination unit to determine, on a basis of the track information, the train location information, and interceptor candidate information, whether there is an interceptor between the train and a first monitoring scope, when the forward monitoring device monitors an obstacle on the track in the first monitoring scope, the interceptor being not the obstacle, the interceptor blocking a view of the first monitoring scope from the train, the interceptor candidate information indicating candidates for the interceptor that blocks a view from the train, the first monitoring scope including a spot on the track at a first distance from the train along the track in a travelling direction of the train.

Advantageous Effects of Invention

According to the present disclosure, the forward monitoring device can provide an advantage of reducing or preventing misidentification of the obstacle when monitoring an area in the travelling direction of the train.

DESCRIPTION OF EMBODIMENTS

A forward monitoring device and a forward monitoring method according to embodiments of the present disclosure will be described in detail below with reference to the drawings.

First Embodiment

Figure 1:
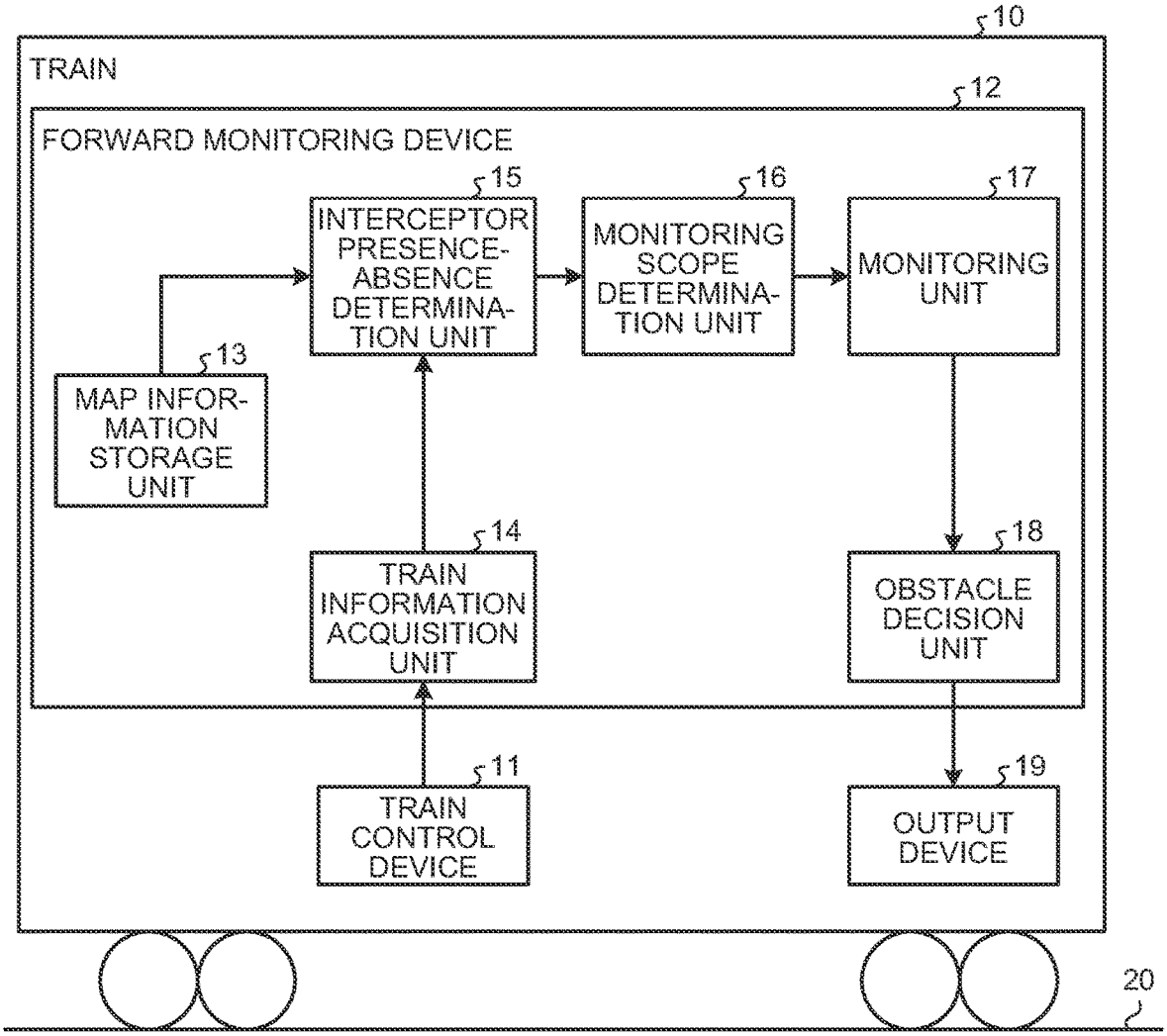
FIG. 1 is a diagram illustrating an example configuration of a forward monitoring device according to a first embodiment.

FIG. 1 is a diagram illustrating an example configuration of a forward monitoring device 12 according to a first embodiment. The forward monitoring device 12 is installed on a train 10. The train 10 monitors whether there is an obstacle on a track 20 in the travelling direction, using the forward monitoring device 12 during running on the track 20. The train 10 includes a train control device 11, the forward monitoring device 12, and an output device 19. The forward monitoring device 12 is connected to the train control device 11 and to the output device 19. The forward monitoring device 12 includes a map information storage unit 13, a train information acquisition unit 14, an interceptor presence-absence determination unit 15, a monitoring scope determination unit 16, a monitoring unit 17, and an obstacle decision unit 18.

The train control device 11 detects the location and the speed of the train 10, using devices such as a wayside device (not illustrated) installed on the ground and an on-vehicle device and a tachogenerator (both not illustrated) installed on the train 10. The train control device 11 outputs, to the forward monitoring device 12, train location information representing the detected location of the train 10 and train speed information indicating the detected speed of the train 10. The train control device 11 detects the location of the train 10, using a common method similarly to conventional cases.

The map information storage unit 13 stores track information indicating the location and the track geometry of the track 20 on which the train 10 is to run. The map information storage unit 13 also stores location information on track-side features including structures such as a signal and a building alongside the track 20, and natural objects such as a tree and a cliff alongside the track 20. The map information storage unit 13 stores the track information and the location information on track-side features collectively, the track information and the location information defining map information. The track information may be represented using a kilometrage from a location defined as the start point, the latitude and the longitude, coordinates providing three-dimensionally measured points, etc., or a combination thereof. The location of a track-side feature may be represented by the latitude and the longitude, coordinates based on three-dimensionally measured points, a combination of location information on the immediately previous station and the kilometrage, etc., or a combination thereof. When, for example, the track information and the location information on track-side features are represented using three-dimensional coordinate values, the map information can be generated by a mobile mapping system (MMS), etc. A track-side feature that is three-dimensionally measured using the MMS can be represented by coordinates of points that form that track-side feature, but coordinates of a single point among the points that form that track-side feature may be used as a representative value. Alternatively, a three-dimensional shape model, which represented by an approximate contour of each track-side feature, is generated from points that define that feature, and the thus generated model is defined as the location information on a track-side feature. A single point $P^i$ of a three-dimensionally measured track-side feature can be expressed as a three-dimensional coordinate value $P^i(x^i, y^i, z^i)$, using coordinate values along three axes in an x-axis direction, a y-axis direction, and a z-axis direction.

The map information storage unit 13 stores, as the representative value of each track-side feature, for example, data on coordinate values along three axes in the x-axis direction, the y-axis direction, and the z-axis direction, or stores that data representing a three-dimensional shape model or points themselves. The map information storage unit 13 also stores data on a coordinate values along three axes in the x-axis direction, the y-axis direction, and the z-axis direction, of each of locations at predetermined intervals on the track 20 indicated in terms of the kilometrage, for example. Note that the x-axis direction, the y-axis direction, and the z-axis direction can be defined such that, for example, the x-y axes form the horizontal plane using the planar cartesian coordinate system provided by the announcement of Ministry of Land, Infrastructure and Transport used in Japan, and the z-axis extends in the height direction. Another usable coordinate system has the origin at any point, e.g., the origin at the start point in kilometrage, and the x-axis direction extending in the east direction, the y-axis direction extending in the north direction, and the z-axis direction extending in the vertically upward direction. The unit of data representing the coordinate values of each point can be, but not limited to, meters (m) or the like. The map information storage unit 13 can store a location coordinate of the track 20 represented by a three-dimensional coordinate value by storing three-dimensional coordinate values at individual locations in kilometrage, e.g., at every one meter, on the track 20. In the present embodiment, the map information storage unit 13 stores the track information and the location information on track-side features, using a combination of a value in kilometrage and a three-dimensional coordinate value. The map information storage unit 13 may store the map information during running of the train 10, that which was measured in advance, or a combination thereof. Note that the track information may be design information used for laying the track 20.

The train information acquisition unit 14 obtains, from the train control device 11, the train location information representing the location of the train 10 and the train speed information representing the speed of the train 10. The train information acquisition unit 14 outputs the train location information and the train speed information of the train 10 to the interceptor presence-absence determination unit 15. Note that the train information acquisition unit 14 may be configured to obtain only the train location information, and output the train location information to the interceptor presence-absence determination unit 15.

The interceptor presence-absence determination unit 15 obtains the track information from the map information storage unit 13, and receives the train location information and the train speed information from the train information acquisition unit 14. In the present embodiment, the interceptor presence-absence determination unit 15 also obtains the location information on track-side features from the map information storage unit 13, the location information being defined as interceptor candidate information that provides candidates for an interceptor that blocks the view from the train 10. In monitoring an obstacle on the track 20 in a first monitoring scope including a spot on the track 20 at a first distance L1 from the train 10 along the track in the travelling direction of the train 10, the interceptor presence-absence determination unit 15 determines whether there in an interceptor between the train 10 and the first monitoring scope on the basis of the track information, the train location information, the train speed information, and the interceptor candidate information. The interceptor, which is an object that blocks the view of the first monitoring scope from the train 10, is neither present on the track 20 nor is an obstacle. In the present embodiment, the interceptor presence-absence determination unit 15 determines whether a track-side feature will act as an interceptor. When the interceptor presence-absence determination unit 15 determines that there is an interceptor, the interceptor presence-absence determination unit 15 outputs interceptor information indicating that there is an interceptor. For example, the interceptor presence-absence determination unit 15 outputs, to the monitoring scope determination unit 16, the interceptor information that is interceptor location information representing the location of the interceptor. Note that the interceptor presence-absence determination unit 15 may determine whether there is an interceptor between the train 10 and the first monitoring scope, on the basis of the track information, the train location information, and the interceptor candidate information, without using the train speed information.

The monitoring scope determination unit 16 receives, from the interceptor presence-absence determination unit 15, the interceptor information, i.e., the interceptor location information. The monitoring scope determination unit 16 also receives the track information, the train location information, and the train speed information from the interceptor presence-absence determination unit 15. Note that the monitoring scope determination unit 16 may obtain the track information directly from the map information storage unit 13, and may obtain the train location information and the train speed information directly from the train information acquisition unit 14. On the basis of the interceptor location information, the track information, the train location information, and the train speed information, the monitoring scope determination unit 16 calculates a second distance L2 over which the view from the train 10 is not blocked by the interceptor. The second distance L2 is a distance from the train 10 shorter than the first distance L1, on the track 20 along the track in the travelling direction of the train 10. The monitoring scope determination unit 16 determines that a second monitoring scope, which includes a spot at the second distance L2, is the monitoring scope for an obstacle. In addition, when the monitoring scope determination unit 16 no longer receives the interceptor location information from the interceptor presence-absence determination unit 15, the monitoring scope determination unit 16 returns the monitoring scope for an obstacle, from the second monitoring scope to the first monitoring scope. The monitoring scope determination unit 16 outputs, to the monitoring unit 17, information on the determined monitoring scope.

The monitoring unit 17 monitors the monitoring scope received from the monitoring scope determination unit 16 to detect an object. The object includes, as described above, track-side features, which are structures such as a signal and a building alongside the track 20 and natural objects such as a tree and a cliff alongside the track 20. In addition, the object includes an obstacle that hinders running of the train 10 on the track 20. An obstacle is, for example, an automobile or a person who has entered the track 20 with a grade crossing closed, a rock fallen off a cliff, a passenger fallen from a station platform, or a passenger on a wheelchair left on a grade crossing. The monitoring unit 17 is a device capable of detecting the track-side feature and the obstacle, and is, for example, a stereo camera including two or more cameras, a light detection and ranging (LIDAR), a radio detection and ranging (RADAR), or the like. The monitoring unit 17 may be configured to include two or more devices.

The monitoring unit 17 generates a distance image from data obtained by monitoring the monitoring scope, and outputs the generated distance image to the obstacle decision unit 18. The distance image is a monitoring result which the monitoring unit 17 provides as a result of monitoring area around the train 10. The distance image includes one or both of a two-dimensional image, and a three-dimensional image including distance information. The monitoring unit 17 is installed on the leading vehicle of the train 10. When the train 10 includes multiple vehicles, the monitoring unit 17 is installed in each of the leading and trailing vehicles as the leading vehicle becomes the trailing vehicle or vice versa, depending on the travelling direction. For example, when the train 10 is a ten-car train made up of vehicles no. 1 to no. 10, vehicle no. 1 or vehicle no. 10 will be the leading vehicle, depending on the travelling direction. In this case, the monitoring unit 17 is provided on each of vehicle no. 1 and vehicle no. 10 of the train 10. The forward monitoring device 12 uses the monitoring unit 17 provided on the leading vehicle in the travelling direction of the train 10.

The obstacle decision unit 18 determines presence or absence of an obstacle in the travelling direction of the train 10 on the basis of the distance image received from the monitoring unit 17. When the obstacle decision unit 18 determines that the distance image includes an obstacle, the of decision unit 18 generates obstacle detection information, which is information indicating that an obstacle has been detected, and outputs the generated obstacle detection information to the output device 19. The obstacle detection information may be information merely indicating that an obstacle has been detected, or may include information on the location where the obstacle has been detected.

Upon receiving the obstacle detection information from the obstacle decision unit 18, the output device 19 outputs, to, for example, the driver of the train 10, information indicating that an obstacle has been detected. The output device 19 may provide a monitor, etc. that indicates, for example, to the driver of the train 10, that an obstacle has been detected. Alternatively, the output device 19 may provide may provide a speaker, etc. that emits, to that train driver, etc. voice that indicates that an obstacle has been detected.

Figure 2:
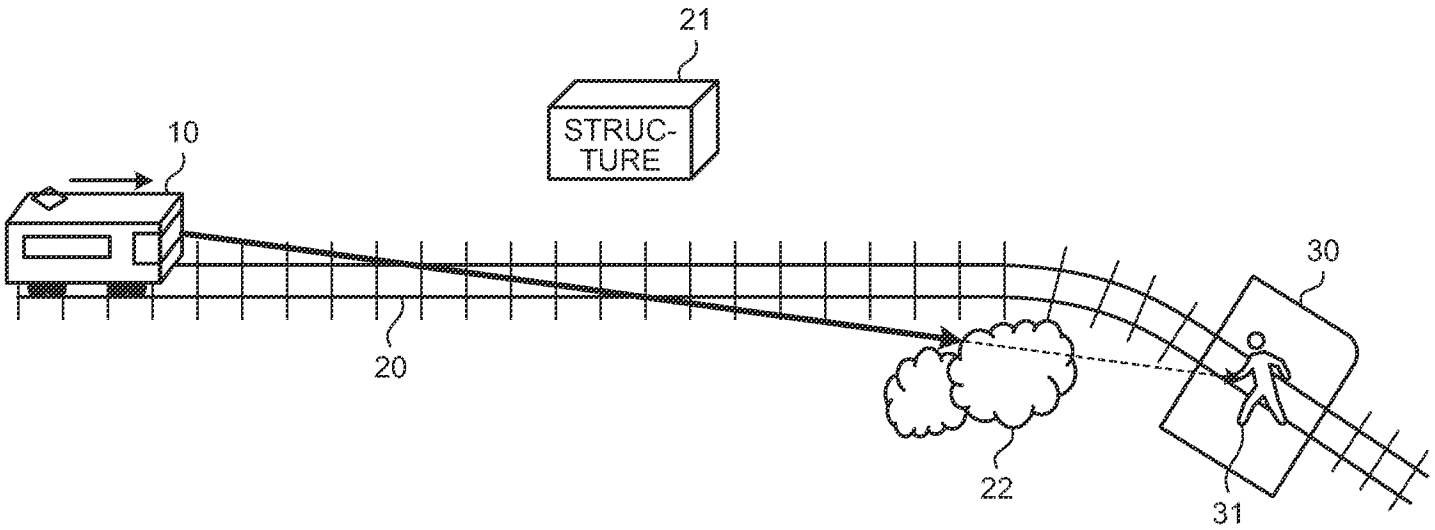
FIG. 2 is a first diagram illustrating an example of operation of the forward monitoring device according to the first embodiment.

An operation of the forward monitoring device 12 will next be described. FIG. 2 is a first diagram illustrating an example of operation of the forward monitoring device 12 according to the first embodiment. In FIG. 2, the train 10 runs in a direction from left to right of FIG. 2 as indicated by the arrow above the train 10. This also applies to the next and subsequent figures. FIG. 2 illustrates a situation in which the train 10 running on the track 20 is trying to detect an obstacle 31 on the track 20 in the travelling direction of the train 10. In an attempt to detect the obstacle 31 on the track 20, the train 10 does not monitor the entire area on the track 20 extending the first distance L1, which is a predetermined distance, from the train 10, but monitors the monitoring scope 30 that is the first monitoring scope including the location at the first distance L1 from the train 10. This is because the forward monitoring device 12 uses a stereo camera, a LIDAR, a RADAR, or the like as the monitoring unit 17, which may result in an unclear image except in the monitoring scope 30 in focus in the train 10. The train 10 had monitored the area over the first distance L1 between the train 10 and the monitoring scope 30 before the train 10 reached the location illustrated in FIG. 2. That is, the train 10 monitored chat area over the distance L1 between the train 10 and the monitoring scope 30 when the train 10 was running on a section (not illustrated in FIG. 2) located on the left of the train 10. Note that the location at the first distance L1 on the track 20 from the train 10 may be the center of the first monitoring scope, or may be a location nearer to the train 10 in the first monitoring scope.

The track geometry of the track 20 on which the train 10 is to run may not always be linear, but may curve to the right or left as illustrated in FIG. 2. In addition, the track 20 may be on a rising or falling slope. In the example of FIG. 2, the train 10 is unable to view the monitoring scope 30 on the track 20 located the first distance L1 ahead of the train 10 in the travelling direction because a natural object 22 alongside the track 20 blocks the train 10 viewing the monitoring scope 30. In this case, the monitoring unit 17 of the forward monitoring device 12 fails to detect the obstacle 31 in the monitoring scope 30 as the natural object 22 blocks the monitoring unit 17 viewing the obstacle 31. When the track 20 curves to the left with respect to the travelling direction of the train 10, opposite to the case of FIG. 2, the train 10 may be unable to view the monitoring scope 30 on the track 20 located the first distance L1 ahead of the train 10 in the travelling direction because a structure 21 alongside the track 20 blocks the train 10 viewing the monitoring scope 30. In this case, the monitoring unit 17 of the forward monitoring device 12 may fail to detect the obstacle 31 in the monitoring scope 30 as the structure 21 blocks the monitoring unit 17 viewing the obstacle 31.

Figure 3:
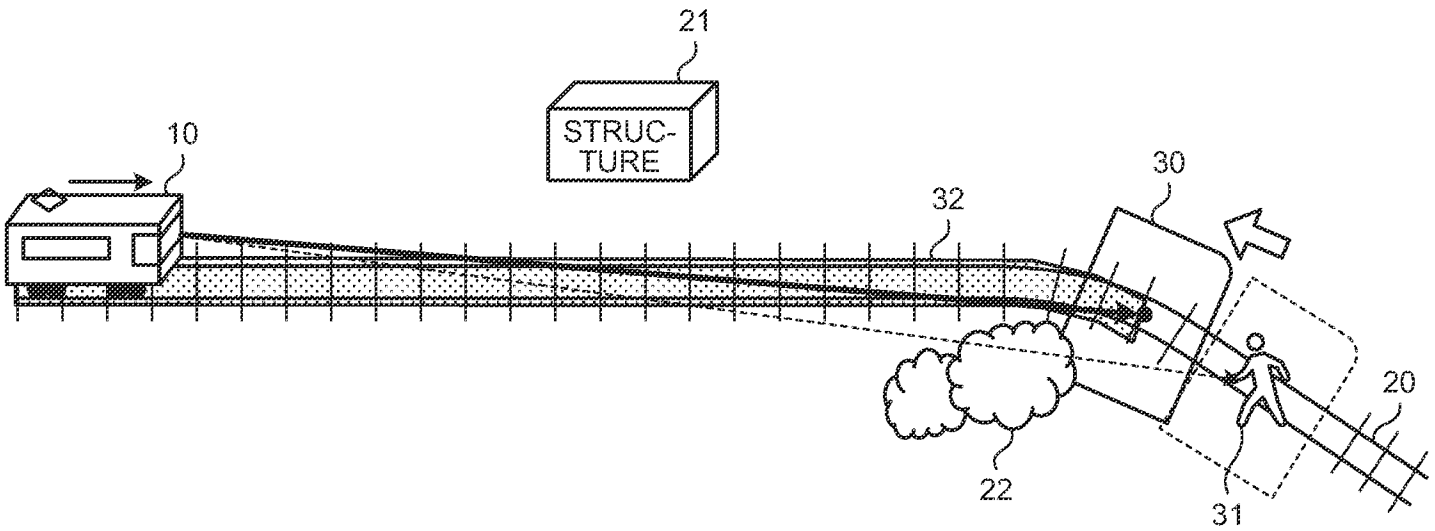
FIG. 3 is a second diagram illustrating an example of operation of the forward monitoring device according to the first embodiment.

In view of this, in the present embodiment, the forward monitoring device 12 of the train 10 reduces the distance to the monitoring scope 30 monitored by the train 10, to a distance to a location viewable from the train 10. That is, the forward monitoring device 12 reduces the distance to the monitoring scope 30 to a distance to a location where the monitoring unit 17 can detect the obstacle 31. FIG. 3 is a second diagram illustrating an example of operation of the forward monitoring device 12 according to the first embodiment. FIG. 3 illustrates a situation in which the distance to the monitoring scope 30 for monitoring the obstacle 31 on the track 20 in the travelling direction of the train 10 is reduced by the train 10 from the first distance L1 to the second distance L2. In FIG. 3, the second distance L2, which is a distance on the track 20 from the train 10, allows an area between the train 10 and the monitoring scope 30 not to be blocked by an interceptor such as the structure 21 or the natural object 22. That is, the forward monitoring device 12 monitors the obstacle 31, with the monitoring scope 30 that is the second monitoring scope including the location at the second distance L2 less than the first distance L1. Note that, in FIG. 3, an already-monitored scope 32 is the area that had been monitored before the train 10 reached the location illustrated in FIG. 3. By reducing the distance to the monitoring scope 30 to the second distance L2, the forward monitoring device 12 of the train 10 can check whether the obstacle 31 is present on the track 20 in the monitoring scope 30 located the second distance L2 ahead of the train 10. Note that the location at the second distance L2 on the track 20 from the train 10 may be the center of the second monitoring scope, or may be a location in the second monitoring scope on a side of the train 10.

Figure 4:
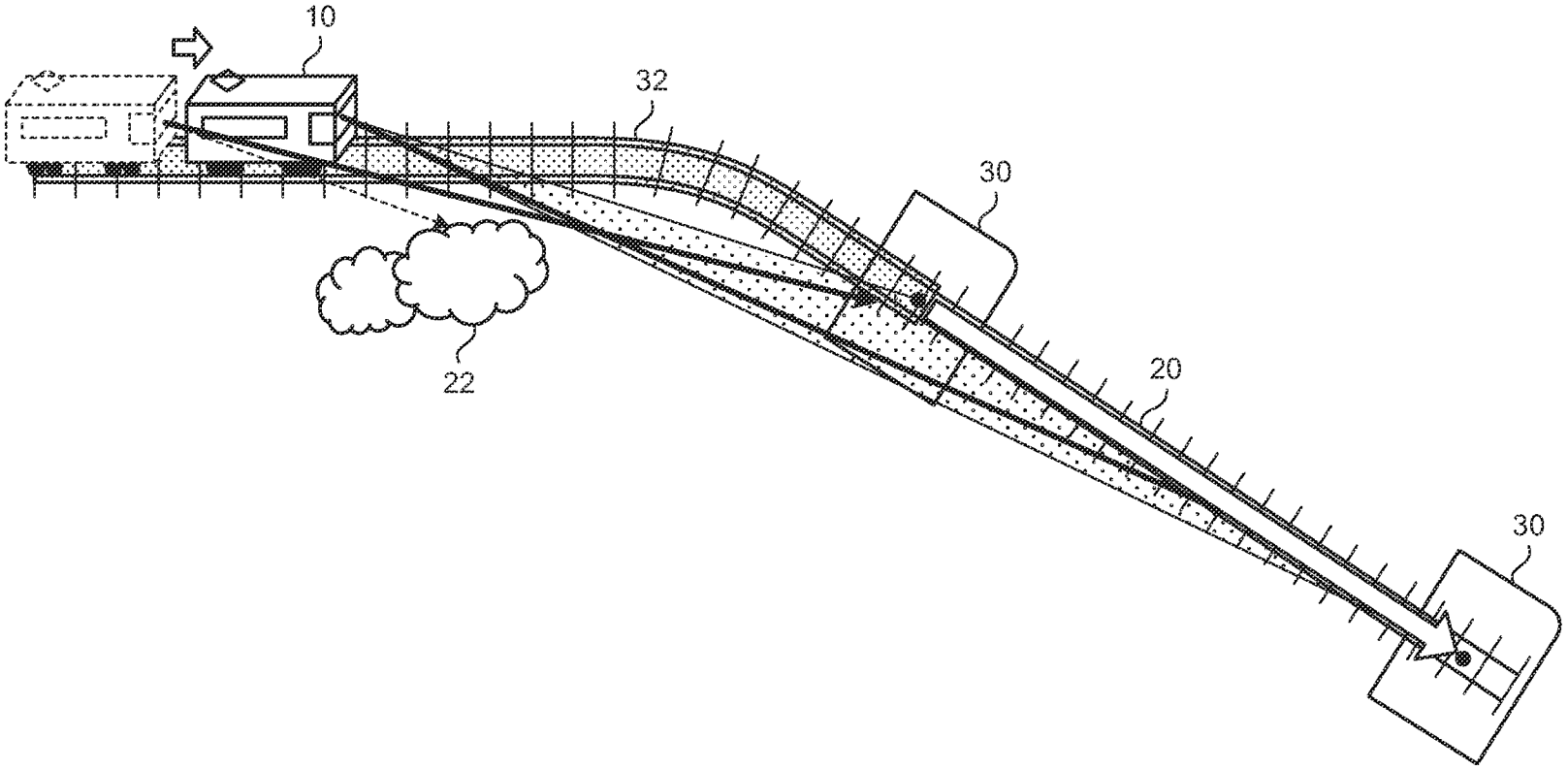
FIG. 4 is a third diagram illustrating an example of operation of the forward monitoring device according to the first embodiment.

The train 10 continues running, such that the train 10 travels past the natural object 22, i.e., an interceptor, and comes to view a location at the first distance L1 on the track 20. At this point, the forward monitoring device 12 of the train 10 returns the distance to the monitoring scope 30 for monitoring the obstacle 31, from the second distance L2 to the first distance L1. FIG. 4 is a third diagram illustrating an example of operation of the forward monitoring device 12 according to the first embodiment. FIG. 4 illustrates a situation in which as a result of running in the travelling direction, i.e., in a direction from left to right of the figure in the example of FIG. 4, past the natural object 22, i.e., an interceptor, the train 10 comes to view the location at the first distance L1. In this process, the forward monitoring device 12 gradually extends the distance to the monitoring scope 30 from the second distance L2 such that the distance is brought back to the first distance L1, thereby making it possible to avoid occurrence of an unmonitored scope. As discussed above, the forward monitoring device 12 of the train 10 reduces the distance to the monitoring scope 30 to the second distance L2 when the forward monitoring device 12 attempts to monitor presence or absence of the obstacle 31 on the track 20 in the monitoring scope 30 located the first distance L1 ahead, but fails to view the spot at the first distance L1 because a track-side feature such as the structure 21 or the natural object 22 acts as an interceptor.

Figure 5:
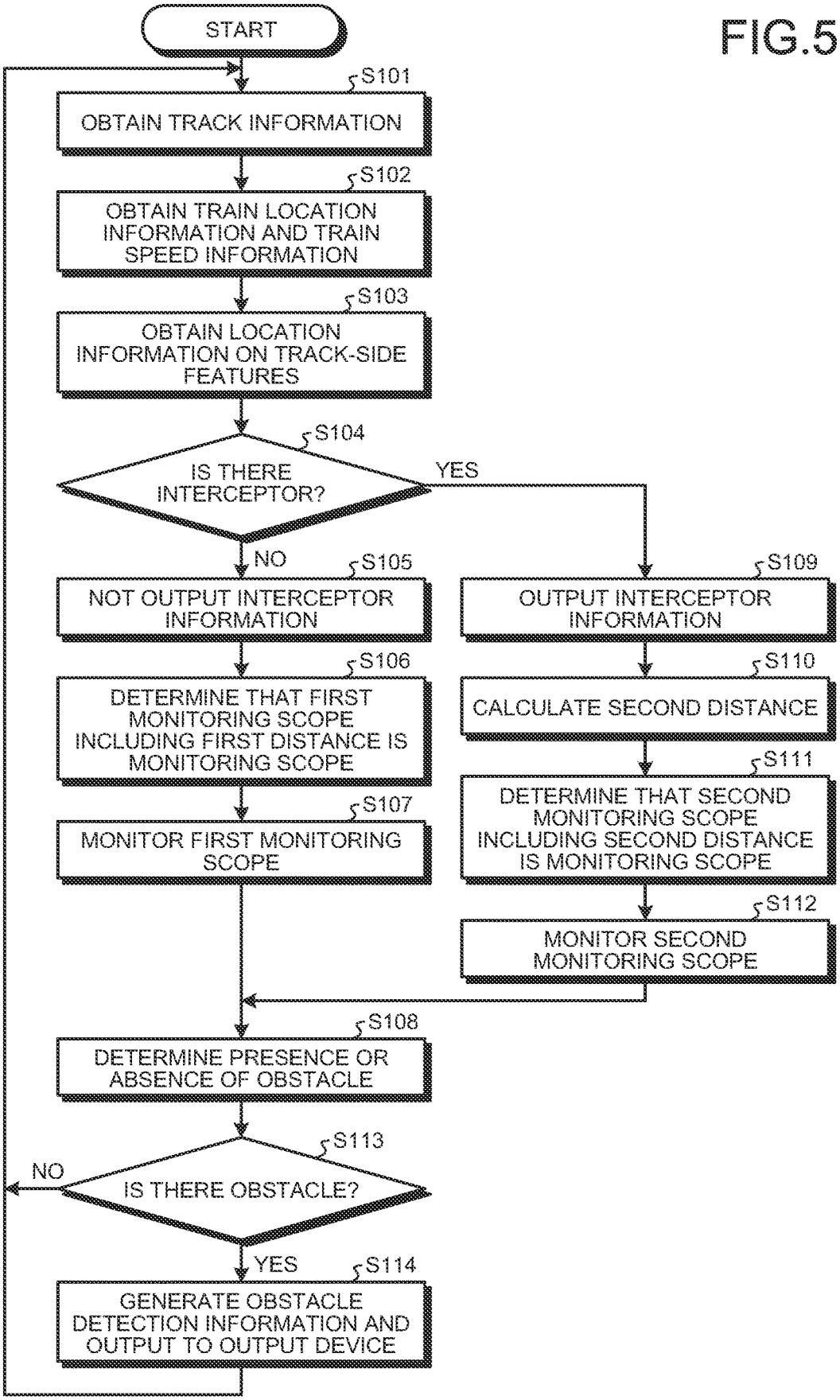
FIG. 5 is a flowchart illustrating an operation of the forward monitoring device according to the first embodiment.

An operation of the forward monitoring device 12 will next be described using a flowchart. FIG. 5 is a flowchart illustrating an operation of the forward monitoring device 12 according to the first embodiment. In the forward monitoring device 12, the interceptor presence-absence determination unit 15 obtains the track information from the map information storage unit 13 (step S101). The interceptor presence-absence determination unit 15 receives the train location information and the train speed information of the train 10 from the train information acquisition unit 14 (step S102). The interceptor presence-absence determination unit 15 obtains, from the map information storage unit 13, the location information on track-side features as the interceptor candidate information (step S103). Note that the interceptor presence-absence determination unit 15 may simultaneously obtain the track information and the location information on track-side features from the map information storage unit 13. In addition, the interceptor presence-absence determination unit 15 may obtain all the location information on track-side features stored in the map information storage unit 13, or may obtain only the train location information on the train 10 and the location information of track-side features in an area including the first monitoring scope. The interceptor presence-absence determination unit 15 determines whether there is an interceptor that blocks the view, in an area from the train 10 to the first monitoring scope including the first distance L1 in the travelling direction of the track 20 (step S104).

The interceptor presence-absence determination unit 15 determines whether there is an interceptor at step S104, in the following manner. Consider a line-of-sight vector having a start point that is the train location obtained from the train location information, and an end point that is the spot at the first distance L1 in the travelling direction of the track 20. When there exists the structure 21 or the natural object 22 crossing this line-of-sight vector, the interceptor presence-absence determination unit 15 determines that there is an interceptor that blocks the view, and otherwise, determines that there is no interceptor. When the location information on track-side features is in the form of a three-dimensional shape model, the determination of whether track-side features cross the line-of-sight vector is made in accordance with based on whether a surface of that three-dimensional shape model crosses the line-of-sight vector. When the location information on track-side features is in the form of points, the interceptor presence-absence determination unit 15 determines that there is an interceptor when, for example, points defining the track-side feature exist in a vicinity of, e.g., within 5 cm from, the line-of-sight vector. When the location information on track-side features is in the form of a representative point, the interceptor presence-absence determination unit 15 determines that there is an interceptor when, for example, the representative point defining the track-side feature exists in a vicinity of, e.g., within 1 m from, the line-of-sight vector. The height of the start point of the line-of-sight vector may be defined as the level of the track or as the height of the cab of the train 10. Similarly, the height of the end point of the line-of-sight vector may be defined as the level of the track or as a certain height above the track, e.g., 1 m.

When there is no interceptor (step S104: No), the interceptor presence-absence determination unit 15 does not output interceptor information (step S105). Note that the interceptor presence-absence determination unit 15 may output, to the monitoring scope determination unit 16, information indicating that there is no interceptor. The interceptor presence-absence determination unit 15 also outputs the track information, and the train location information and the train speed information of the train 10, to the monitoring scope determination unit 16. On the basis of the track information, and the train location information and the train speed information on the train 10, the monitoring scope determination unit 16 determines that the first monitoring scope including the first distance L1 is the monitoring scope 30 as the monitoring scope 30 for the monitoring unit 17 to monitor the obstacle 31 (step S106). When receiving no interceptor information from the interceptor presence-absence determination unit 15, the monitoring scope determination unit 16 determines that the first monitoring scope including the first distance L1 is the monitoring scope 30 as an initial setting. The monitoring scope determination unit 16 outputs, to the monitoring unit 17, information on the first monitoring scope as the monitoring scope 30. The monitoring unit 17 monitors the first monitoring scope as the monitoring scope 30 (step S107). The obstacle decision unit 18 determines the presence or absence of the obstacle 31 on the basis of the monitoring result of the monitoring unit 17 (step S108).

When there is an interceptor (step S104: Yes), the interceptor presence-absence determination unit 15 outputs interceptor information indicating that there is an interceptor (step S109). The interceptor information is, for example, a warning to the driver (not illustrated) of the train 10. The warning to the driver is an alarm, a display, or the like. Similarly to the output device 19, the interceptor presence-absence determination unit 15 may display the presence of an interceptor through a monitor or the like, or may output voice indicating that there is an interceptor through a speaker or the like. The interceptor presence-absence determination unit 15 further outputs, to the monitoring scope determination unit 16, interceptor location information representing the location of the interceptor as the interceptor information. The interceptor presence-absence determination unit 15 also outputs the track information, and the train location information and the train speed information on the train 10, to the monitoring scope determination unit 16. On the basis of the interceptor location information, the track information, the train location information on the train 10, and the train speed information on the train 10, the monitoring scope determination unit 16 calculates the second distance L2 on the track 20 from the train 10, as the distance to the monitoring scope 30 for the monitoring unit 17 to monitor the obstacle 31 (step S110). A view over the second distance L2 is not be blocked by an interceptor. The monitoring scope determination unit 16 determines that the second monitoring scope including the second distance L2 is the monitoring scope 30 (step S111). The monitoring scope determination unit 16 outputs, to the monitoring unit 17, information on the second monitoring scope as the monitoring scope 30. The monitoring unit 17 monitors the second monitoring scope as the monitoring scope 30 (step S112). The obstacle decision unit 18 determines the presence or absence of the obstacle 31 on the basis of the monitoring result of the monitoring unit 17 (step S108).

When the obstacle decision unit 18 determines that there is an obstacle (step S113: Yes), the obstacle decision unit 18 generates obstacle detection information, which is information indicating that an obstacle has been detected, and outputs the generated obstacle detection information to the output device 19 (step S114). When the obstacle decision unit 18 determines that there is no obstacle (step S113: No), the obstacle decision unit 18 skips the operation at step S114.

The forward monitoring device 12 periodically repeats the foregoing operation. By reducing the distance to the monitoring scope 30 to the second distance L2 shorter than the first distance L1, the forward monitoring device 12 can continue monitoring the obstacle 31 even when there is an interceptor between the train 10 and the monitoring scope 30 located the first distance L1 ahead. In addition, when there is no longer an interceptor between the train 10 and the monitoring scope 30 located the first distance L1 ahead, the forward monitoring device 12 can return the monitoring condition to an initial condition of monitoring the obstacle 31 by changing the distance to the monitoring scope 30 to the first distance L1.

A hardware configuration of the forward monitoring device 12 will next be described. In the forward monitoring device 12, the map information storage unit 13 is a memory. The monitoring unit 17 is, as described above, a sensor such as a stereo camera or a LIDAR. The train information acquisition unit 14, the interceptor presence-absence determination unit 15, the monitoring scope determination unit 16, and the obstacle decision unit 18 are implemented in a processing circuitry. The processing circuitry may be a processor that executes a program stored in a memory, and the memory, or may be a dedicated hardware element.

Figure 6:
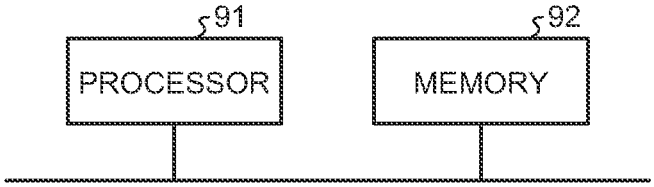
FIG. 6 is a diagram illustrating an example in which a combination of a processor and a memory forms a processing circuitry included in the forward monitoring device according to the first embodiment.

FIG. 6 is a diagram illustrating an example in which a combination of a processor and a memory forms a processing circuitry included in the forward monitoring device 12 according to the first embodiment. When the processing circuitry includes a processor 91 and a memory 92, each functionality of the processing circuitry of the forward monitoring device 12 is implemented in software, firmware, or a combination of software and firmware. The software or firmware is described as a program, and is stored in the memory 92. In the processing circuitry, each functionality is implemented by the processor 91 by reading and executing a program stored in the memory 92. That is, the processing circuitry includes the memory 92 for storing programs that cause the processing of the forward monitoring device 12 to be performed. It can also be said that these programs cause a computer to perform a procedure and a method to be performed by the forward monitoring device 12.

In this respect, the processor 91 may be a central processing unit (CPU), a processing unit, a computing unit, a microprocessor, a microcomputer, a digital signal processor (DSP), or the like. In addition, the memory 92 is, for example, a non-volatile or volatile semiconductor memory such as a random access memory (RAM), a read-only memory (ROM), a flash memory, an erasable programmable ROM (EPROM), or an electrically erasable programmable ROM (EEPROM) (registered trademark); a magnetic disk, a flexible disk, an optical disk, a compact disc, a MiniDisc, a digital versatile disc (DVD), or the like.

Figure 7:
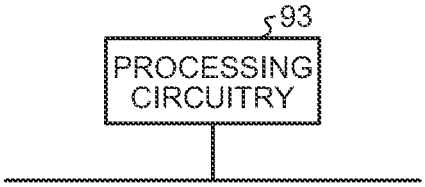
FIG. 7 is a diagram illustrating an example in which a dedicated hardware element forms the processing circuitry included in the forward monitoring device according to the first embodiment.

FIG. 7 is a diagram illustrating an example in which a dedicated hardware element forms the processing circuitry included in the forward monitoring device 12 according to the first embodiment. When the processing circuitry includes a dedicated hardware element, a processing circuitry 93 illustrated in FIG. 7 is, for example, a single circuit, a set of multiple circuits, a programmed processor, a parallel programmed processor, an application specific integrated circuit (ASIC), a field programmable gate array (FPGA), or a combination thereof. The functionalities of the forward monitoring device 12 may be implemented in the processing circuitry 93 on a function-by-function basis, or may be implemented in the processing circuitry collectively as a whole.

Each functionality of the forward monitoring device 12 may be implemented partially in a dedicated hardware element, and partially in software or firmware. Thus, the processing circuitry can implement each functionality described above in a dedicated hardware element, software, firmware, or a combination thereof.

As described above, according to the present embodiment, the interceptor presence-absence determination unit 15 of the forward monitoring device 12 obtains, as interceptor candidate information, location information on track-side features such as the structure 21 and the natural object 22, stored in the map information storage unit 13, and determines, whether there is an interceptor that blocks the view from the train 10 to the monitoring scope 30 that is the first monitoring scope. This can prevent the forward monitoring device 12 from misidentifying an interceptor present between the train 10 and the monitoring scope 30, as the obstacle 31. In addition, when an interceptor blocks a view of the monitoring scope 30 that is the first monitoring scope, the forward monitoring device 12 reduces the distance from the train 10 to the monitoring scope 30 to the second distance L2 less than the first distance L1. By thus reducing the distance to the monitoring scope 30, the forward monitoring device 12 can continue monitoring the obstacle 31 and also avoid unnecessary monitoring operation as the forward monitoring device 12 does not monitor the scope which the forward monitoring device 12 cannot directly monitor because the view from the forward monitoring device 12 to that scope is blocked.

Moreover, when the train 10 travels past the natural object 22, i.e., an interceptor, and comes to view a location at the first distance L1, the forward monitoring device 12 gradually extends the distance to the monitoring scope 30 such that the distance is brought from the second distance L2 back to the first distance L1, thereby making it possible to avoid occurrence of an unmonitored scope. Note that the first distance L1 in the present embodiment can be, but not limited to, for example, 300 m as a distance for the train 10 to stop after applying a brake. In addition, although the present embodiment has been described assuming that the first distance L1 is a constant, the forward monitoring device 12 may be configured to change the first distance L1 according to the train speed information or the running location of the train 10.

Second Embodiment

The first embodiment is based on the assumption that track-side features such as the structure 21 and the natural object 22 alongside the track 20 may act as an interceptor. A second embodiment will next be described giving an example in which another train running on a parallel track acts as an interceptor.

Figure 8:
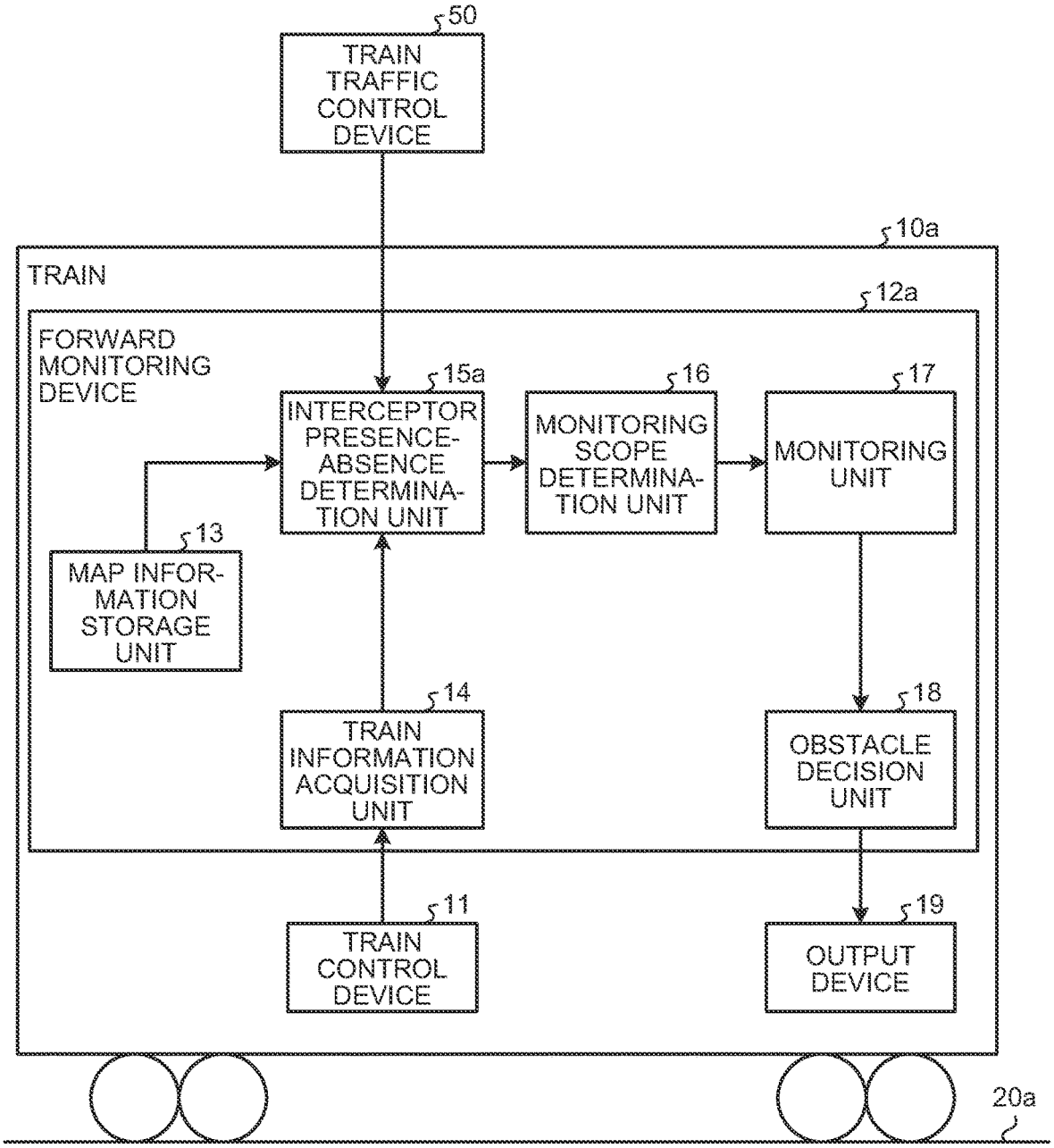
FIG. 8 is a diagram illustrating an example configuration of a forward monitoring device according to a second embodiment.

FIG. 8 is a diagram illustrating an example configuration of a forward monitoring device 12*a* according to the second embodiment. The forward monitoring device 12*a* is installed on a train 10*a*. The train 10*a* monitors whether there is the obstacle 31 on a track 20*a* in the travelling direction, using the forward monitoring device 12*a* during running on the track 20*a*. In the present embodiment, the train 10*a* is connected to a train traffic control device 50 via wireless communication. The train 10*a* includes the forward monitoring device 12*a* in place of the forward monitoring device 12 of the train 10 of the first embodiment. The forward monitoring device 12*a* includes an interceptor presence-absence determination unit 15*a* in place of the interceptor presence-absence determination unit 15 of the forward monitoring device 12 of the first embodiment.

Similarly to the interceptor presence-absence determination unit 15 of the first embodiment, the interceptor presence-absence determination unit 15*a* obtains the track information from the map information storage unit 13, and receives the train location information and the train speed information of the train 10 from the train information acquisition unit 14. In addition, the interceptor presence-absence determination unit 15*a* of the present embodiment obtains, from the train traffic control device 50, location information on another train running on a track extending along the track 20*a* as interceptor candidate information that provides candidates for an interceptor that blocks the view from the train 10*a*. In monitoring the obstacle 31 on the track 20*a* in the first monitoring scope including the first distance L1 from the train 10*a* on the track 20*a* in the travelling direction of the train 10*a*, the interceptor presence-absence determination unit 15*a* determines, on the basis of the track information, the train location information, the train speed information, and the interceptor candidate information, whether there is an interceptor between the train 10*a* and the first monitoring scope, the interceptor being not the obstacle 31, but blocking the view of the first monitoring scope from the train 10*a*. In the present embodiment, the interceptor presence-absence determination unit 15*a* determines whether another train acts as an interceptor. When the interceptor presence-absence determination unit 15*a* determines that there is an interceptor, the interceptor presence-absence determination unit 15*a* outputs interceptor information indicating that there is an interceptor. For example, the interceptor presence-absence determination unit 15*a* outputs, to the monitoring scope determination unit 16, interceptor location information as the interceptor information.

The train traffic control device 50 manages operation of the train 10*a* and other trains (not illustrated), collecting the location information on these individual trains train from the train 10*a* and the other trains.

Figure 9:
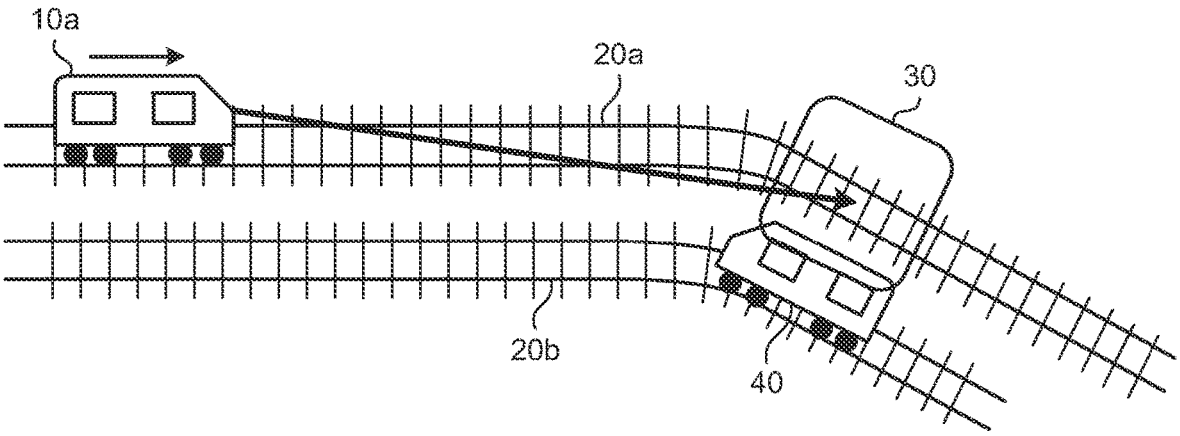
FIG. 9 is a first diagram illustrating an example of operation of the forward monitoring a device according to the second embodiment.
Figure 10:
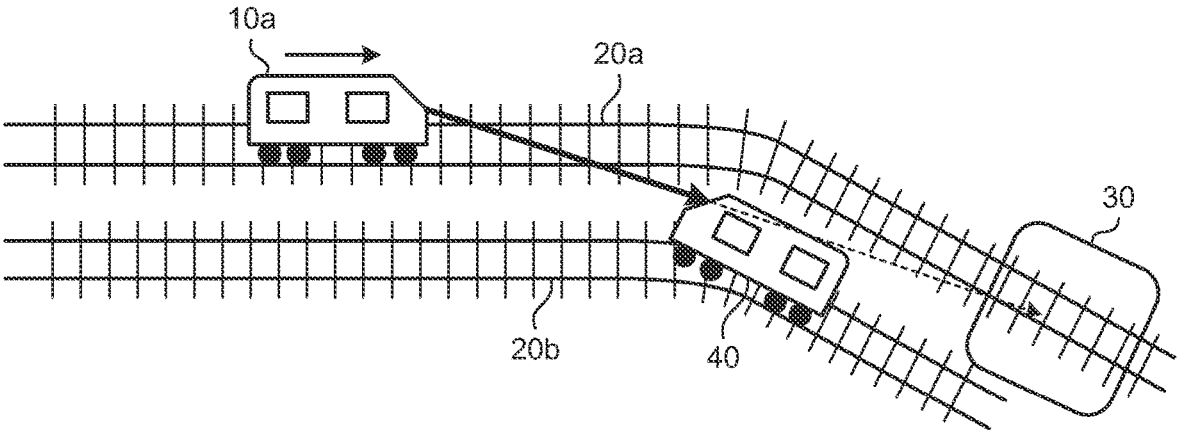
FIG. 10 is a second diagram illustrating an example of operation of the forward monitoring a device according to the second embodiment.

An operation of the forward monitoring device 12*a* will next be described. FIG. 9 is a first diagram illustrating an example of operation of the forward monitoring device 12*a* according to the second embodiment. In FIG. 9, the train 10*a* runs in a direction from left to right of FIG. 9 as indicated by the arrow above the train 10*a*. In FIG. 9, also, in contrast to the train 10*a* running on the track 20*a* in a direction from left to right of FIG. 9, another train 40 is running on a parallel track 20*b* in a direction from right to left of FIG. 9, i.e., in the opposite direction. This also applies to the next and subsequent figures. In the situation illustrated in FIG. 9, the train 10*a* may misidentify the other train 40 in the monitoring scope 30 as the obstacle 31 by monitoring the monitoring scope 30. FIG. 10 is a second diagram illustrating an example of operation of the forward monitoring device 12*a* according to the second embodiment. In the situation illustrated in FIG. 10, the other train 40 acts as an interceptor for the train 10*a* as the other train 40 blocks the view from the train 10*a* to the monitoring scope 30.

Figure 11:
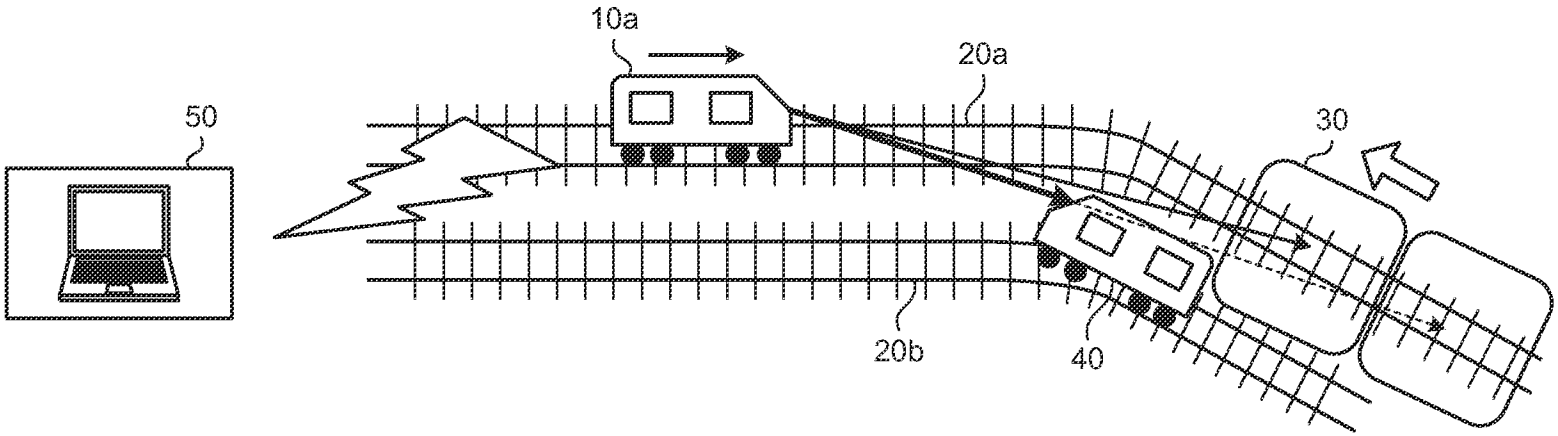
FIG. 11 is a third diagram illustrating an example of operation of the forward monitoring device according to the second embodiment.

In view of this, in the present embodiment, the forward monitoring device 12*a* of the train 10*a* reduces the distance to the monitoring scope 30 monitored by the train 10*a*, to a distance to a location viewable from the train 10*a*. That is, the forward monitoring device 12*a* reduces the distance to the monitoring scope 30 to a distance to a location where the monitoring unit 17 can detect the obstacle 31. The forward monitoring device 12*a* obtains, from the train traffic control device 50, the location information on the other train 40 running on the parallel track 20*b*. Then, when the other train 40 is included in the monitoring scope 30, or the other train 40 acts as an interceptor, the forward monitoring device 12*a* reduces the distance to the monitoring scope 30, to a distance to a location where the monitoring unit 17 can detect the obstacle 31. FIG. 11 is a third diagram illustrating an example of operation of the forward monitoring device 12*a* according to the second embodiment. When the other train 40 is included in the monitoring scope 30 as illustrated in FIG. 9, or the other train 40 between the train 10*a* and the monitoring scope 30 acts as an interceptor as illustrated in FIG. 10, the train 10*a* reduces the first distance L1 to the monitoring scope 30 to the second distance L2, and continues monitoring the obstacle 31. Note that although not illustrated, after the other train 40 travels past the train 10*a*, the train 10*a* returns the distance to the monitoring scope 30, from the second distance L2 to the first distance L1 similarly to the train 10 of the first embodiment.

Figure 12:
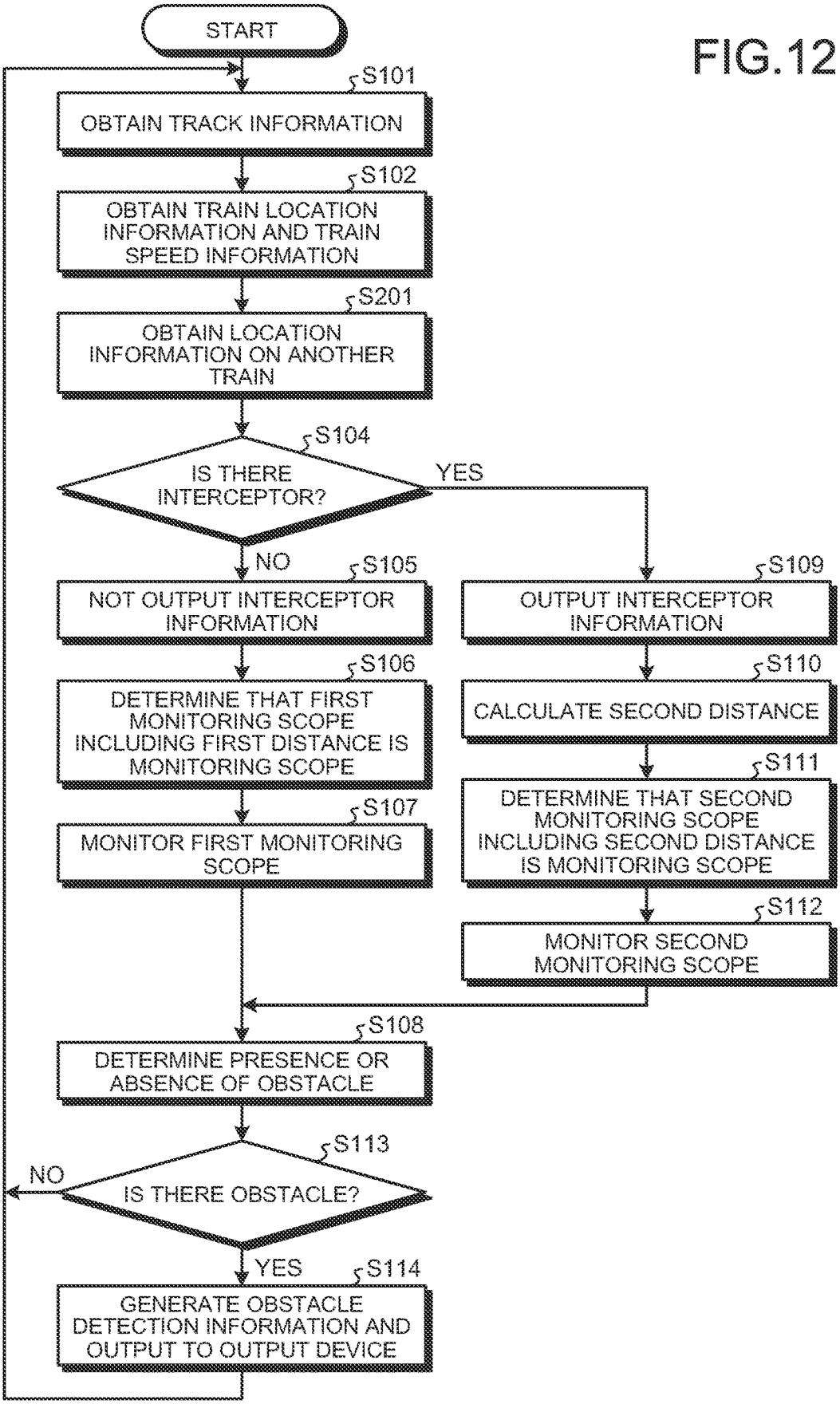
FIG. 12 is a flowchart illustrating an operation of the forward monitoring device according to the second embodiment.

An operation of the forward monitoring device 12*a* will next be described using a flowchart. FIG. 12 is a flowchart illustrating an operation of the forward monitoring device 12*a* according to the second embodiment. In the forward monitoring device 12*a*, the interceptor presence-absence determination unit 15*a* obtains the track information from the map information storage unit 13 (step S101). The interceptor presence-absence determination unit 15*a* receives the train location information and the train speed information of the train 10 from the train information acquisition unit 14 (step S102). The interceptor presence-absence determination unit 15*a* obtains, from the train traffic control device 50, the location information on the other train 40 as the interceptor candidate information (step S201). The interceptor presence-absence determination unit 15*a* determines whether there is an interceptor at step S104, in the following manner. When the line-of-sight vector crosses the location information on the other train 40, the interceptor presence-absence determination unit 15*a* determines that there is an interceptor, and otherwise, determines that there is no interceptor. The interceptor presence-absence determination unit 15*a* determines that the line-of-sight vector crosses the location information on the other train 40 and thus there is an interceptor when, for example, the line-of-sight vector extends through the vicinity of, e.g., a location at 1 m or less from, the location information on the other train 40. When the formation of the other train 40 is known, a solid representing the contour of the other train 40 is placed at the location information on the other train 40. In this case, when that solid crosses the line-of-sight vector, the interceptor presence-absence determination unit 15*a* determines that there is an interceptor. Alternatively, a scope of the parallel track within which the other train 40 exists is defined. In this case, when the line-of-sight vector extends through that scope of the parallel track, the interceptor presence-absence determination unit 15*a* determines that there is an interceptor. The operation thereafter is similar to the operation of the forward monitoring device 12 in the first embodiment illustrated in FIG. 5.

Note that FIGS. 9 to 11 are based on the assumption that the other train 40 is a train approaching the train 10*a* from the opposite direction, but the other train 40 is not limited thereto. For example, a four-track line includes a further parallel track disposed on the left side in the traveling direction of the train 10*a*, and a train on this further parallel track in the same travelling direction as the train 10*a*, in which case the train 10*a* may also obtain, from the train traffic control device 50, interceptor candidate information that is location information on that train running in the same travelling direction.

As described above, according to the present embodiment, the forward monitoring device 12*a* obtains the interceptor candidate information, i.e., the information on the other train 40 running on the parallel track 20*b*, and determines whether there is an interceptor that blocks the view from the train 10*a* to the monitoring scope 30 that is the first monitoring scope. Also in this case, the forward monitoring device 12*a* can provide an advantage similar to the advantage of the forward monitoring device 12 of the first embodiment.

Note that in the present embodiment, the forward monitoring device 12*a* uses location information on the other train 40 as the interceptor candidate information. Alternatively, the forward monitoring device 12*a* may further use the location information on track-side features. Specifically, the forward monitoring device 12*a* may perform the operation of step S201 illustrated in FIG. 12 before or after the operation of step S103 illustrated in FIG. 5. This can further prevent the forward monitoring device 12*a* from misidentifying an interceptor between the train 10*a* and the monitoring scope 30 as the obstacle 31.

The configurations described in the foregoing embodiments are merely examples. These configurations may be combined with a known other technology, and configurations of different embodiments may be combined together. Moreover, part of the configurations may be omitted and/or modified without departing from the spirit thereof.

REFERENCE SIGNS LIST

10, 10*a* train; 11 train control device; 12, 12*a* forward monitoring device; 13 map information storage unit; 14 train information acquisition unit; 15, 15*a* interceptor presence-absence determination unit; 16 monitoring scope determination unit; 17 monitoring unit; 18 obstacle decision unit; 19 output device; 20, 20*a*, 20*b* track; 21 structure; 22 natural object; 30 monitoring scope; 31 obstacle; 32 already-monitored scope; 40 another train; 50 train traffic control device.

The invention claimed is:

1. A forward monitoring device to be installed on a train, the forward monitoring device comprising:

map information storage circuitry to store track information representing a location and a track geometry of a track on which the train is to run;

train information acquisition circuitry to obtain train location information on the train; and interceptor presence-absence determination circuitry to determine, on a basis of the track information, the train location information, and interceptor candidate information, whether there is an interceptor between the train and a first monitoring scope, when the forward monitoring device monitors an obstacle on the track in the first monitoring scope, the interceptor being not the obstacle, the interceptor blocking a view of the first monitoring scope from the train, the interceptor candidate information indicating candidates for the interceptor that blocks a view from the train, the first monitoring scope including a spot on the track at a first distance from the train along the track in a travelling direction of the train.

2. The forward monitoring device according to claim 1, wherein the map information storage circuitry stores location information on track-side features including a structure and a natural object alongside the track, and the interceptor presence-absence determination circuitry obtains the location information on track-side features from the map information storage unit, as the interceptor candidate information, and determines whether the track-side features act as the interceptor.

3. The forward monitoring device according to claim 1, wherein the interceptor presence-absence determination circuitry obtains, from a train traffic control device, location information on another train running on a parallel track, as the interceptor candidate information, and determines whether the other train acts as the interceptor, the train traffic control device being a device that collects location information on the train, and manages operation of the train.

4. The forward monitoring device according to claim 1, wherein when the interceptor presence-absence determination circuitry determines that the interceptor is present, the interceptor presence-absence determination unit outputs interceptor information indicating that the interceptor is present.

5. The forward monitoring device according to claim 4, wherein the interceptor presence-absence determination circuitry outputs interceptor location information as the interceptor information, and the forward monitoring device further comprises monitoring scope determination circuitry to receive the interceptor location information from the interceptor presence-absence determination circuitry, and determine that a second monitoring scope is a monitoring scope for the obstacle, the second monitoring scope including a spot at a second distance from the train on the track along the track in the travelling direction of the train, over which second distance a view from the train is not blocked by the interceptor, the second distance being shorter than the first distance.

6. The forward monitoring device according to claim 5, wherein when the monitoring scope determination circuitry no longer receives the interceptor location information from the interceptor presence-absence determination circuitry, the monitoring scope determination circuitry returns the monitoring scope for the obstacle to the first monitoring scope.

7. The forward monitoring device according to claim 1, wherein the train information acquisition circuitry further obtains train speed information on the train, and the interceptor presence-absence determination circuitry determines whether the interceptor is present further using the train speed information.

8. A forward monitoring method for use in a forward monitoring device to be installed on a train, the forward monitoring method comprising:

obtaining train location information on the train; and determining, on a basis of track information representing a location and a track geometry of a track on which the train is to run, the train location information, and interceptor candidate information, whether there is an interceptor between the train and a first monitoring scope, when the forward monitoring device monitors an obstacle on the track in the first monitoring scope, the interceptor being not an obstacle, the interceptor blocking a view of the first monitoring scope from the train, the interceptor candidate information indicating candidates for the interceptor that blocks a view from the train, the first monitoring scope including a spot on the track at a first distance from the train along the track in a travelling direction of the train.

9. The forward monitoring method according to claim 8, wherein determining whether there is the interceptor includes obtaining location information on track-side features including a structure and a natural object alongside the track, as the interceptor candidate information, and determines whether the track-side features act as the interceptor.

10. The forward monitoring method according to claim 8, wherein determining whether there is the interceptor includes obtaining, from a train traffic control device, location information on another train running on a parallel track, as the interceptor candidate information, and determining whether the other train acts as the interceptor, the train traffic control device being a device that collects location information on the train, and manages operation of the train.

11. The forward monitoring method according to claim 8, wherein determining whether there is the interceptor includes, when the interceptor presence-absence determination unit determines that the interceptor is present, outputting interceptor information indicating that the interceptor is present.

12. The forward monitoring method according to claim 11, wherein determining whether there is the interceptor includes outputting interceptor location information as the interceptor information, and the forward monitoring method further comprises receiving the interceptor location information, and determining that a second monitoring scope is a monitoring scope for the obstacle, the second monitoring scope including a spot at a second distance from the train on the track along the track in a travelling direction of the train, over which second distance a view from the train is not blocked by the interceptor, the second distance being shorter than the first distance.

13. The forward monitoring method according to claim 12, further comprising when no longer receiving the interceptor location information, the monitoring scope determination unit returning the monitoring scope for the obstacle to the first monitoring scope.

14. The forward monitoring method according to claim 8, wherein obtaining the train location information further includes obtaining train speed information on the train, and determining whether there is the interceptor includes determining whether the interceptor is present further using the train speed information.

* * * * *